United States Patent [19]

Robbins

[11] Patent Number: 5,024,435

[45] Date of Patent: Jun. 18, 1991

[54] TOY BAT ASSEMBLY

[76] Inventor: William D. Robbins, 37 Ridge Rd., Succasunna, N.J. 07876

[21] Appl. No.: 499,808

[22] Filed: Mar. 27, 1990

Related U.S. Application Data

[63] Continuation of Ser. No. 241,016, Sep. 2, 1988, abandoned.

[51] Int. Cl.[5] ..... A63B 59/06

[52] U.S. Cl. ..... 273/26 B; 273/72 R

[58] Field of Search ..... 273/72 R, 72 A, 26 B, 273/25, 26 R; 124/16, 34

[56] References Cited

U.S. PATENT DOCUMENTS

| | | | |
|---|---|---|---|
| 3,111,314 | 11/1963 | Topper | 273/72 R |
| 3,236,521 | 2/1966 | Knott | 273/72 R |
| 3,496,924 | 2/1970 | Miller | 273/72 R |
| 3,545,752 | 12/1970 | Hill | 124/34 |
| 4,521,015 | 6/1985 | Carafeno | 124/16 |

*Primary Examiner*—Edward M. Coven
*Assistant Examiner*—Marti S. Graham
*Attorney, Agent, or Firm*—Louis E. Marn

[57] ABSTRACT

There is disclosed a toy baseball bat assembly comprised of a hollow cylindrically-shaped toy bat assembly including a barrel portion defining a magazine to receive a plurality of balls and a handle assembly including a latching assembly for locking a compressed spring-loaded launching assembly and for releasing the launching assembly for concomitantly ejecting one of the balls from the magazine at an angle substantially perpendicular to the toy bat assembly in a manner to permit a user to strike at such ejected ball with the toy bat assembly.

5 Claims, 3 Drawing Sheets

10
22
146
148
144
28
24
20
26
118
128
100
4
4
80
76
86
74
96
110
92
18
28
26
24
12
14
160
158
154
B
B
B
104
16
34
30
40
38
42
36
58
3
3
44
24
32
28
26

10
22
146
148
144
150
24
20
26
118
100
128
76
86
74
80
110
96
92
18
28
24
12
14
26
160
156
154
B
B
B
104
16
30
36
34
54
38
58
44
42
40
24
32
28
26
B

TOY BAT ASSEMBLY

This is a continuation of application Ser. No. 07/241,016, filed Sep. 2, 1988 now abandoned.

BACKGROUND OF THE INVENTION (1) Field of the Invention

This invention relates to an improved toy bat assembly, and more particularly to an improved toy bat assembly including a self-contained ball magazine.

(2) Description of Prior Art

In U.S. Pat. No. 3,111,314 to Topper, there is disclosed a "Toy Fungo Bat" comprised of a fungo bat having its larger striking end hollow to contain the toy balls therein, an opening in the peripheral wall surface being provided for insertion of the balls into the hollow portion of the bat and the subsequent ejection of the balls therefrom. An ejection mechanism is mounted within the hollow end portion and is adapted to selectively, singly eject balls contained within the hollow portion.

In use, the bat is held with the opening uppermost so the balls will be ejected upwardly to enable them to be struck with the bat while still in the air. While the assembly singly ejects balls from within the hollow portion the ejection mechanism tends to eject the ball laterally outwardly away from the user and outside the manual swing perimeter thereby defeating the purpose of the assembly. Additionally, the cocking mechanism required the removal of a hand from the bat handle, and thus repositioning of the hand on the bat handle prior to a subsequent use as well as the positioning of the release mechanism requiring combined finger-palm force and concomitant ineffective launching.

OBJECT OF THE INVENTION

An object of the present invention is to provide an improved toy bat assembly having self-contained ball magazine ejecting balls substantially perpendicular to the axis of the assembly.

Another object of the present invention is to provide an improved toy bat assembly having a self-contained ball magazine including an ejection assembly placed in a loaded condition by hands-on-action the user permitting of facile repetitive usage.

Still another object of the present invention is to provide an improved toy bat assembly having a self-contained ball magazine permitting facile and effective release of respective balls.

SUMMARY OF THE INVENTION

These and other objects of the present invention are achieved by an improved toy bat assembly comprised of a hollow cylindrically-shaped toy bat assembly including a barrel portion defining a magazine to receive a plurality of balls and a handle assembly including a latching assembly for locking a compressed spring-loaded launching assembly and for releasing the launching assembly for concomitantly ejecting one of the balls from the magazine at an angle substantially perpendicular to the toy bat assembly in a manner to permit a user to strike at such ejected ball with the toy bat assembly.

BRIEF DESCRIPTION OF THE DRAWING

Further objects and advantages of the present invention will become apparent upon consideration of the detailed disclosure thereof, especially when taken with the accompanying drawings wherein.

DETAILED DESCRIPTION OF THE INVENTION

Figure 1:
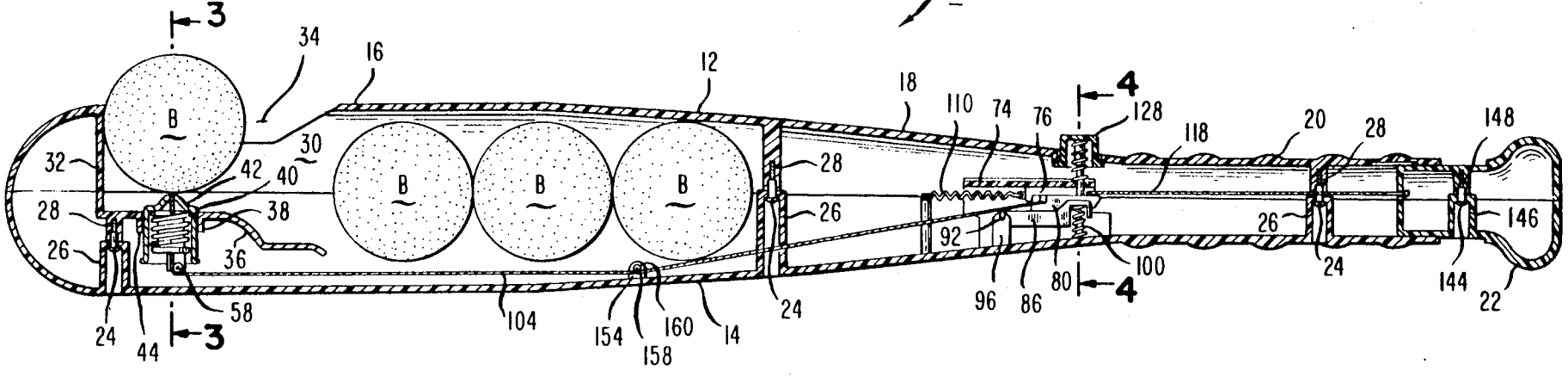
FIG. 1 is a cross-sectional view of the improved toy bat assembly of the present invention with the latching assembly lock in a launching position of the launching assembly.
Figure 2:
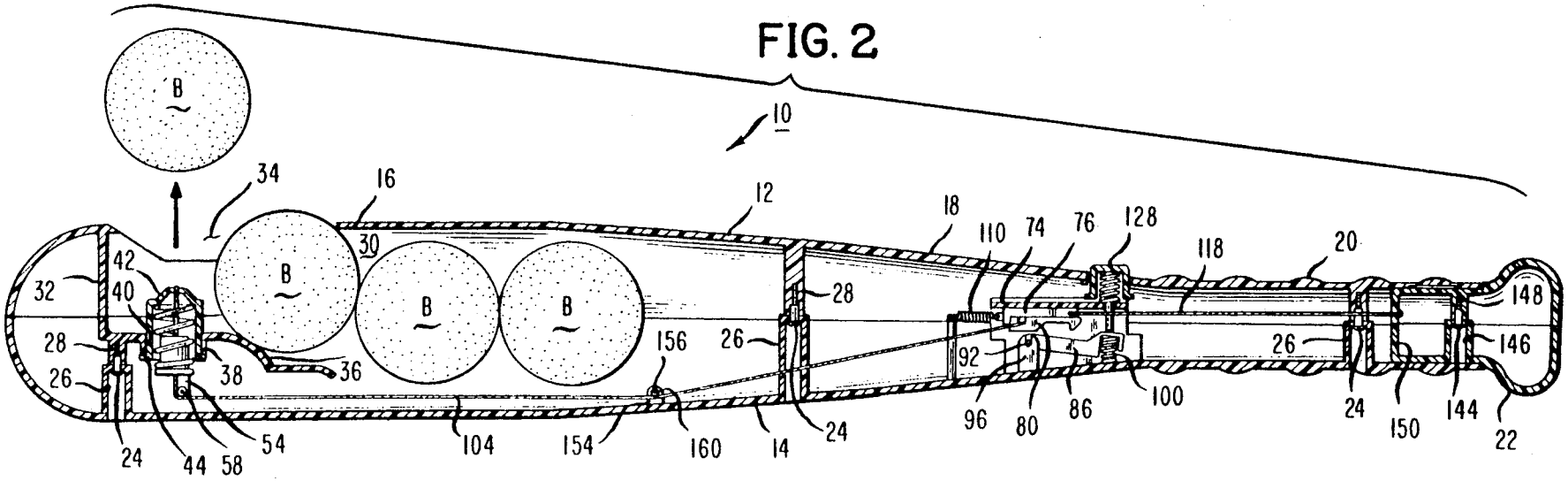
FIG. 2 is a cross-sectional view of the improved toy bat assembly of FIG. 1 with the latching assembly in a released position.

Referring now to the drawings and in particular FIGS. 1 and 2, there is illustrated a toy bat assembly, generally indicated as 10 comprised of bat half members 12 and 14 defining in assemblied relationship a hollow cylindrically-shaped barrel portion 16, an intermediate cylindrically-shaped tapered portion 18 and a cylindrically-shaped handle portion 20. An end handle member 22 is positioned for longitudinal displacement within the handle portion 20 of the toy bat assembly 10 as more fully hereinafter discussed. The half members 12 and 14 are mounted to one another such as by screws 24 within channel mounting members 26 of the bat half member 14 threaded into orifice member 28 formed in the bat half member 12.

The barrel portion 16 of the toy bat assembly 10 defines a magazine chamber 30 for receiving a plurality of balls B, preferably formed of expanded foam material, positioned by hand therein. Proximate a terminal end of the barrel portion 16 in the upper bat half member 12, there is formed a laterally-disposed end wall member 32, from which is provided an opening 34 for insertion and expulsion of the balls B, as more fully hereinafter discussed.

Figure 3:
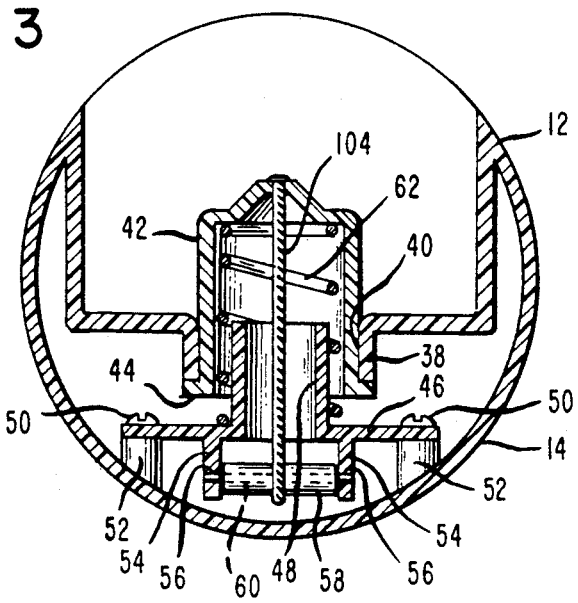
FIG. 3 is an enlarged cross-sectional view taken along the lines 3—3 of FIG. 1.

Longitudinally-extending within the barrel portion 16 there is provided from the wall member 32, a support and guide plate 36 including a downwardly extending cylindrically-shaped housing 38 defining an opening 40 to receive a launching member or column 42 including a limiting flange element 44, referring to FIG. 3. In the lower bat half member 14, there is provided a platform 46 including an upwardly extending cylindrically-shaped member 48 in coaxial alignment with the opening 40, mounted such as by screws 50, to threaded mounting elements 52. The platform member 46 is formed with downwardly extending arm members 54 having orifices 56 for positioning a roller 58 including pin members 60 disposed in the orifice 56. Positioned about and over the member 48 and disposed within the launching member 42, there is provided a coil spring 62 of a preselected compressible force.

Figure 6:
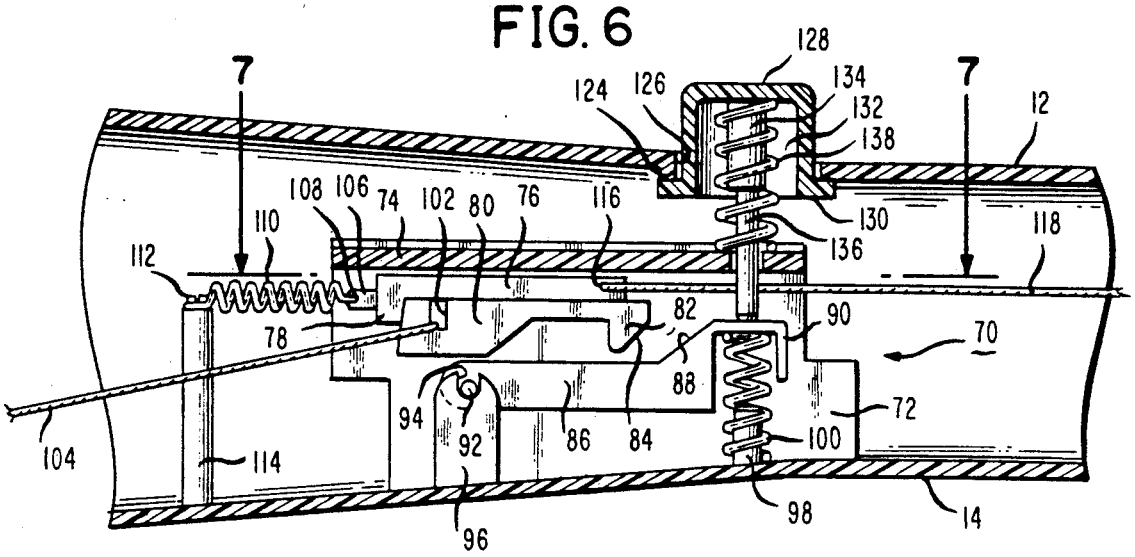
FIG. 6 is an enlarged cross-sectional view of the latching assembly.

Proximate the intermediate tapered portion 18 and the handle portion 20 within the toy bat assembly 10, there is provided a latching or cocking mechanism, generally indicated as 70, referring to FIGS. 4 and 6 to 8, and particularly to FIG. 6, and comprised of a slide housing 72 including an upper wall 74 defining a channel 75 for receiving an upper latching element 76 including downwardly extending arm portion 78, an intermediate latching element 80 including downwardly extending hook element 82 having a leading bevelled surface 84 and lower latching element 86 including upwardly extending bevelled surface 88 terminating in a laterally-disposed engaging surface 90.

The lower latching element 86 is mounted for rotation by pin members 92 disposed in slots 94 formed in upwardly extending arm members 96 formed in the lower bat half member 14. A pin member 98 is formed in the lower bat half member 14 for positioning a spring member 100 to spring load the lower latching element 86. The intermediate latching element 80 is provided with a slot 102 for receiving a launching string member 104, as more fully hereinafter described. The upper latching element 76 is provided with a mounting ear 106 including orifice 108 for receiving an end of a spring member 110. The other end of the spring member 110 is mounted, such as by screw 112 to a mounting post 114 formed on the lower bat half member 14. An end of the upper latching element 76 opposite the mounting ear 106 is provided with an orifice 116 for receiving a latching string member 118.

Figure 7:
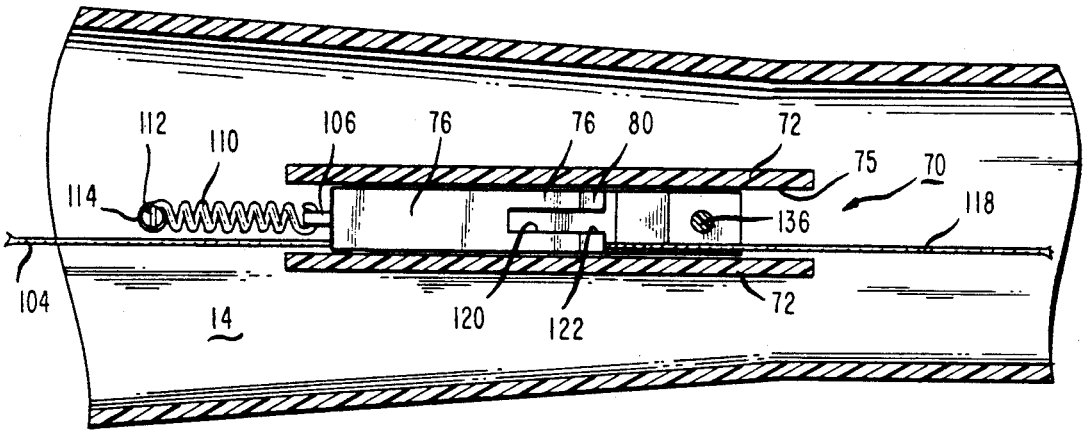
FIG. 7 is a cross-sectional view taken along the lines 7—7 of FIG. 6.
Figure 8:
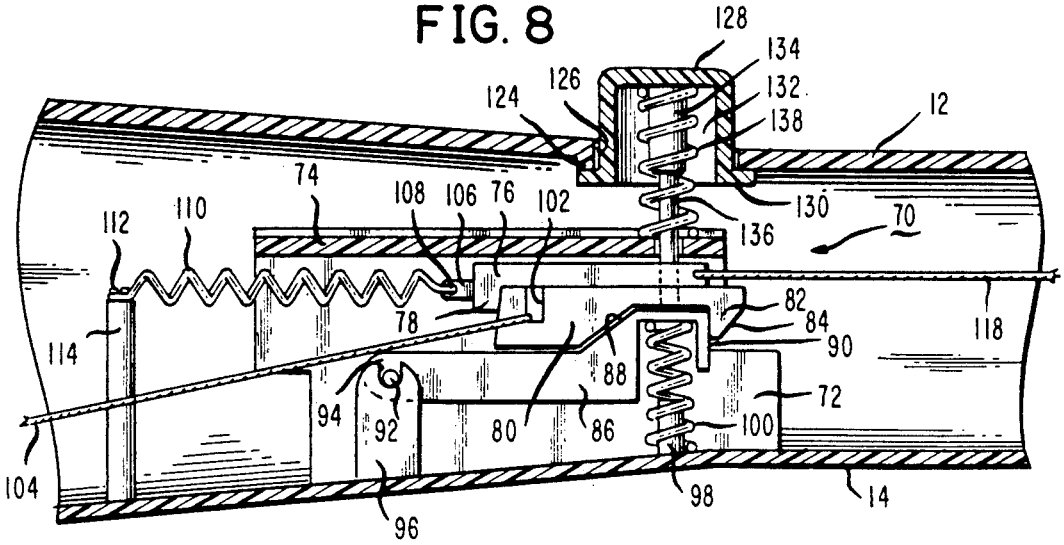
FIG. 8 is an enlarged cross-sectional view of the latching assembly in a cocked position.

Both the upper and intermediate latching elements 76 and 80 are formed with leading slot portions 120 and 122, respectively, referring to FIG. 7. The latching elements 76, 80 and 86 are laterally restrained for longitudinal movement within the channel 75 of the housing member 72 by the upper wall member 75 thereof.

Figure 4:
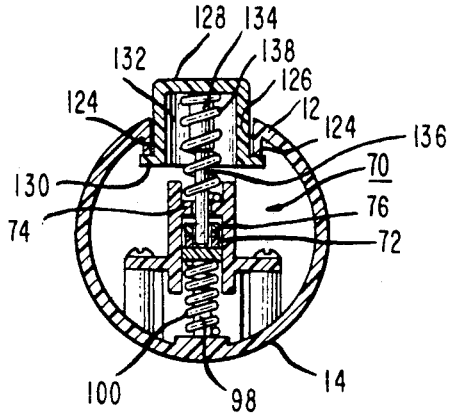
FIG. 4 is an enlarged cross-sectional view taken along the lines 4—4 of FIG. 1.

In the upper bat half member 12 of the toy bat assembly 10 referring particularly to FIG. 4, there is formed an inwardly extending cylindrically-shaped base member 124 defining a channel 126 in coaxial alignment with the pin member 98 for receiving a release button member 128. The button member 128 is formed with a lower outwardly extending flange 130 and defines an internal channel 132. A post member 134 including an elongated pin portion 136 is formed in the button member 128 extending downwardly a distance sufficient to contact an upper surface of the lower latching element 86. About the post member 134, there is provided a spring member 138 for spring loading the button member 128 within the toy bat assembly 10 by contact of the spring member 134 with an upper surface of the wall 74 of the housing member 72.

Figure 5:
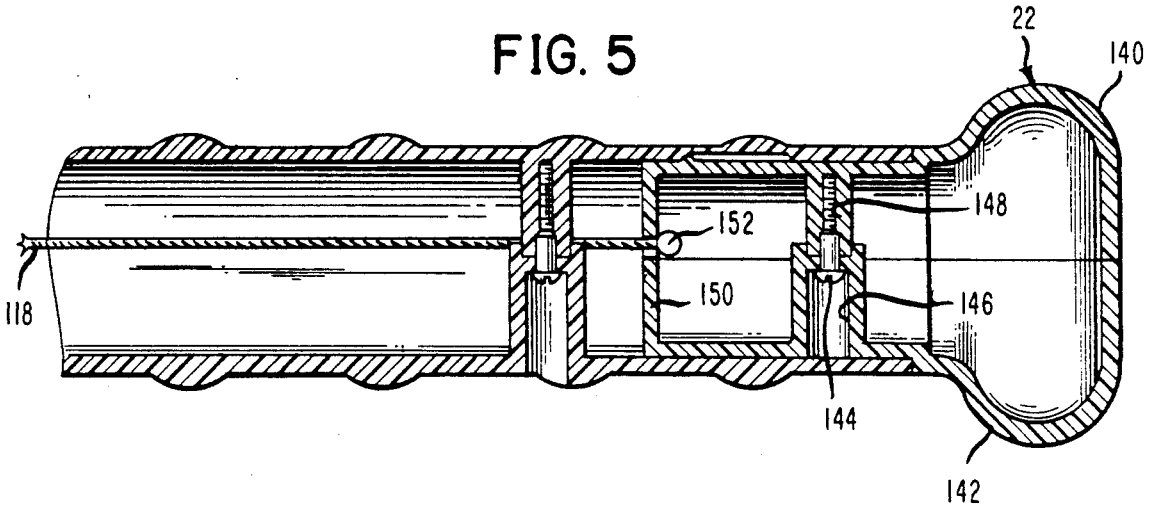
FIG. 5 is an enlarged cross-sectional view of the handle portion of the improved toy bat assembly of the present invention.

The handle member 22, referring to FIG. 5 is comprised of half portions 140 and 142 mounted together such as by screw 144 disposed in channel 146 disposed in threaded mounting element 148 formed in the half portion 140. The handle member 22 is mounted for slidable movement within the handle portion 20 of the toy bat assembly 10 and is formed with end wall 150 for receiving an end 152 of the latching string member 118. Positioned intermediate the toy bat assembly 10 and formed in the lower bat half member 14, referring to FIG. 1 and 2, are upwardly extending arm members 154 including orifices 156 for receiving pin elements 158 of an intermediate roller member 160. The string member 104 is coursed from the intermediate latching element 80 under the roller 160 and about the roller 58 and connected to the launching column 42, such as by inner locking member 162, referring to FIG. 3.

In operation, the magazine 30 is manually loaded with balls B with the user serially grasping the handle portion 20 with a right hand-left hand configuration or visa versa. With the hand furthest from the handle member 22 (or closest to the button), tightly grasping the handle portion, the lower palm portion of the other hand is caused to move the handle member 22 axially out of the handle portion 20 of the toy bat assembly 10 causing tensioning of the string member 118. Continued tensioning of the string member 118 concomitantly causes the upper latching member 76 and engaged intermediate latching member 80 to likewise axially move outwardly within the housing 72 towards the handle portion 20 thereby tensioning the spring 110 as well as tensioning the string 104 and thus lowering the launching column 42 against the compressive forces of the spring 62. Withdrawal of the handle member 22 from the handle portion 20 is continued to the point where the intermediate latching element 80 depresses the lower latching element 86 against the spring 100 and is eventually caused to engage in locked configuration the lower latching element 86 referring to FIG. 8. The slots 120 and 122 of the upper and intermediate latching elements 76 and 80, respectively, permit such elements to extend beyond the pin 136 of the button member 128.

In such position, the launching column 42 is depressed in locked position against the compressive forces of the spring member 62, and the toy bat assembly 10 is ready for launching of a ball. The user causes a ball from the magazine to assume a position atop the launching column 42, and preferably with the toy bat assembly 10 in a horizontal position proceeds with the launching operation, referring to FIG. 1.

Launching of the ball B is effected by the user by depressing the button member 128 with concomitant depression of the lower latching element 86 by its rotation about the pins 92 thereby releasing the upper and intermediate latching elements 76 and 80 from engagement with the lower latching element 86. The latching elements 76 and 80 are caused to return to a starting position by the spring forces of spring member 110, referring to FIGS. 2 and 6. Releasing of such latching elements 76 and 80 effects release of the compressive forces of spring member 162 acting upon the launching column 42 thereby accelerate the launching column 42 to thus propel ball B out of and through the opening 34 in a direction substantially perpendicular to the major axis of the toy bat assembly 10. After such launching of a ball, the user causes the bat to move backward and thence forward to attempt to effect contact between the thus propelled ball and the barrel portion 16 of the toy bat assembly 10.

The locking and release of the latching assembly 20 is continued in like manner until all of the balls have been expelled from the toy bat assembly 10. The process of refilling the magazine is repeated with ball expulsion as long as user interest remains.

The present invention provides a safe, convenient and practical toy baseball bat assembly with an automatic serving function and thus the user can exercise by himself and does not need a serving machine. The user need only to place several balls in the bat before exercise, load the launching column press the button to launch a ball followed by a striking action. It is apparent that different kinds of balls may be used and that the length and/or type of bat may be used according to the playground, etc. Hence, the present invention enables wide applications with no restriction on playgrounds or user's age providing practical exercise, amusement and learning.

While the present invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed:

1. A toy baseball bat assembly which comprises:

a hollow cylindrically-shaped bat including a barrel portion, an intermediate tapered portion and a handle portion, said barrel portion having an opening including an end wall member and defining a magazine to receive a plurality of balls;

a launching means disposed in said barrel portion including a coil means spring mounted on an axis substantially perpendicular to the longitudinal axis of said toy bat assembly for cooperating with said end wall member to expel a ball substantially perpendicular to the longitudinal axis of said toy bat assembly;

latching assembly means for compressing said coil means spring into a cocked position and comprising first, second and third latching element means and a handle member positioned for slidable movement within said handle portion of said toy bat, said handle member being connected to said first latching element means for placing in compression said coil means spring in said cocked position, said first latching element means being spring-loaded for loading to a loading position after placement of said launching assembly means into said cocked position thereby integrating said handle portion to said bat assembly, said first latching element means for driving said second latching element means, said second latching element means connected to said launching assembly means for compressing said coil means spring into said cocked position, said third latching element means for locking said second latching element means in said cocked position; and means disposed on an upper side of said handle portion for contacting said third latching element means of said latching assembly means to release said second latching element means thereby to expel said ball from said barrel portion of said toy baseball bat assembly.

2. The toy baseball bat assembly as defined in claim 1 wherein said means for contacting said third latching element means of said latching means is a spring-loaded button member means.

3. The toy baseball bat assembly as defined in claim 2 wherein said third latching element means is spring-loaded with respect to said button member means, said button member means for disengaging said third latching element means from said second latching element.

4. The toy baseball bat assembly as defined in claim 3 wherein said third latching element means is mounted for rotation.

5. The toy baseball bat assembly as defined in claim 2 wherein said button member means is positioned proximate said intermediate tapered portion of said toy bat.

* * * * *